US005391061A

United States Patent [19]

Iizuka et al.

[11] Patent Number: 5,391,061

[45] Date of Patent: Feb. 21, 1995

[54] HERMETIC TERMINAL COVER AND COMPRESSOR INCORPORATING SAME

[75] Inventors: Tatsuyuki Iizuka, Chigasaki; Etsuro Suzuki, Fujisawa, both of Japan

[73] Assignee: Matsushita Refrigeration Company, Osaka, Japan

[21] Appl. No.: 30,978

[22] Filed: Mar. 12, 1993

[30] Foreign Application Priority Data

Mar. 18, 1992 [JP] Japan ..... 4-061672

[51] Int. Cl.[6] ..... F04B 35/04; H01B 17/30

[52] U.S. Cl. ..... 417/410.1; 174/152 GM; 439/685; 439/935

[58] Field of Search ..... 417/410 R, 902; 174/151, 152 GM, 65 G, 65 SS, 65 R, 50.51, 50.52, 50.53, 50.56, 50.57; 439/685, 519, 926, 566, 935, 685, 693

[56] References Cited

U.S. PATENT DOCUMENTS

| | | | |
|---|---|---|---|
| 2,458,748 | 1/1949 | Stupakoff | 174/152 GM |
| 3,581,191 | 12/1976 | Elbling et al. | 174/152 GM |
| 3,605,076 | 9/1971 | Dozier | 439/936 |
| 3,721,948 | 3/1973 | Brandt et al. | 174/152 GM |
| 4,252,394 | 2/1981 | Miller | 439/566 |
| 4,461,925 | 7/1984 | Bowsky et al. | 439/935 |
| 4,480,151 | 10/1984 | Dozier | 174/153 R |
| 4,580,003 | 4/1986 | Bowsky et al. | 439/685 |
| 4,584,433 | 4/1986 | Bowsky et al. | 174/152 GM |
| 4,609,774 | 9/1986 | Le Mieux et al. | 439/935 |
| 4,700,999 | 10/1987 | Probst | 439/271 |
| 4,786,762 | 11/1988 | Dowsky et al. | 174/152 GM |
| 4,984,973 | 1/1991 | Itamiri-Kinter | 417/902 |
| 5,017,740 | 3/1991 | Honkome et al. | 174/152 GM |

FOREIGN PATENT DOCUMENTS

| | | |
|---|---|---|
| 56-16777 | 2/1981 | Japan . |
| 62-271975 | 11/1987 | Japan . |

*Primary Examiner*—Ricahrd A. Bertsch
*Assistant Examiner*—Peter Korytnyk
*Attorney, Agent, or Firm*—Lowe, Price, LeBlanc & Becker

[57] ABSTRACT

A hermetic terminal cover is arranged to be mounted onto a hermetic terminal of, such as, a closed-type compressor. The hermetic terminal cover has terminal caps for covering respective terminal strips of the hermetic terminal. Each terminal strip includes a terminal pin fixedly passing through a metallic base with an insulator interposed therebetween. The terminal caps are mutually connected by flexible ribs each having a curved shape, and preferably an arc shape. Accordingly, each terminal cap has a high degree of positional or displacement freedom to facilitate mounting of the terminal cap onto the corresponding terminal strip. Further, each terminal cap has an increased thickness at a portion corresponding to an exposed surface of the insulator holding the terminal pin. Accordingly, adverse affection of metallic powders, such as, generation of short circuits and sparks between the terminal pins and the metallic base is effectively prevented.

12 Claims, 6 Drawing Sheets

HERMETIC TERMINAL COVER AND COMPRESSOR INCORPORATING SAME

BACKGROUND OF THE INVENTION

1. Field of the Invention

The present invention relates to a hermetic terminal cover for use in, such as, a closed-type compressor. The present invention further relates to a closed-type compressor employing such a hermetic terminal cover therein.

2. Description of the Prior Art

In a closed-type compressor or the like, a hermetic terminal is arranged at a portion of a sealed case of the compressor for feeding power to an internal electric motor from the exterior thereof. The hermetic terminal includes a metallic base having tubular sections and terminal pins made of an alloy of, such as, iron, nickel and cobalt which respectively pass through the centers of the tubular sections with respective insulators hermetically interposed between the terminal pins and the tubular sections. Since the hermetic terminal is generally exposed to refrigerant and oil in the sealed case of the compressor, each insulator is required to have a high refrigerant resistance and a high oil resistance, and further to firmly support the terminal pin. In order to satisfy all of these requirements, the insulator made of glass has been generally utilized. The hermetic terminal of this type is disclosed, such as, in Japanese Second (examined) Utility Model Publication No. 56-16777.

FIG. 12 corresponds to FIG. 2 of this publication. In FIG. 12, a hermetic terminal generally designated by a reference numeral 100 includes three continuous terminal strips 101. Each terminal strip 101 includes a tubular section 105 and a terminal pin 107 which is fixedly received through the tubular section 105 with an insulator 106 of glass interposed therebetween. Specifically, a dish-shaped metallic base 103 is formed with three through holes 102 each of which is defined by the tubular section 105 of the metallic base 103. Each terminal pin 107 fixedly passes through a center of the through hole 102 in hermetic and electrically insulated manners by means of the glass insulator 106 interposed between the terminal pin 107 and an inner periphery of the tubular section 105. A reference numeral 109 denotes a sealed case of the closed-type compressor, and the hermetic terminal 100 is fixed to the sealed case 109 with its outer periphery welded thereto.

The refrigerant and the oil in the sealed case 109 include therein metallic powders, such as, iron powders and copper powders which have been generated, for example, at the time of assembling the sealed case by welding or due to abrasion produced at the time of sliding movement of an internal piston. These metallic powders are carried by the refrigerant to various places in the sealed case 109 to be adhered or attached thereto. Problem is raised when these metallic powders are attached to an exposed surface of each of the insulators 106 of the hermetic terminal 100. Specifically, when an amount of the metallic powders adhered to the surface of each insulator 106 is increased and a large voltage is impressed to the terminal pin 107 at the time of, for example, restarting the compressor, sparks are liable to be generated between the terminal pin 107 and the tubular section 105 through the attached metallic powders, leading to accidents, such as, the leak and the breakage of the hermetic terminal 100.

In order to solve the above-noted problem, there has been proposed an improved hermetic terminal as disclosed in Japanese First (unexamined) Patent Publication No. 62-271975, which will be explained with reference to FIGS. 13 and 14.

In FIGS. 13 and 14, a reference numeral 111 denotes a disc-shaped protection cover formed, by drawing, of polyethylene terephthalate (hereinafter referred to as "PET") of about 250 to 300 pm. The protection cover 111 has an annular folded portion 112 at its outer peripheral edge, three stepped tubular portions 113 and a center small hole 114. Each of the stepped tubular portions 113 includes an annular bulged portion 116 or an annular step, a large-diameter opening 117 and a small-diameter opening 118.

Dimensions of the relevant portions of the protection cover 111 are set as in the following manner:

An outer diameter of the folded portion 112 is set slightly larger than an inner diameter of the metallic base 103. An inner diameter of the bulged portion 116 is set slightly smaller than an outer diameter of the tubular section 105 of the metallic base 103. A diameter of the large-diameter opening 117 is set larger than the tubular section 105 of the metallic base 103. A diameter of the small-diameter opening 118 is set slightly smaller than an outer diameter of the terminal pin 107. As shown in FIG. 14, the protection cover 111 is mounted onto the hermetic terminal 100 with each terminal pin 107 press-fitly passing through the small-diameter opening 118 of the protection cover 111 and with the folded portion 112 of the protection cover 111 press-fitly engaged with the inner periphery of the metallic base 103.

As appreciated from the foregoing dimensional relationship, fluid-tight conditions are provided between a wall of each small-diameter opening 118 and the corresponding terminal pin 107, between each bulged portion 116 and the corresponding tubular section 105 and between the folded portion 112 and the inner periphery of the metallic base 103. Further, a gap or clearance 120 is provided between the surface of each insulator 106 and the corresponding tubular portion 113 of the protection cover 111. Accordingly, the protection cover 111 of PET hermetically covers the exposed surface of the insulator 106, and in addition, provides the gap 120 therebetween. As appreciated, electric force lines are the largest in number at the surface of the insulator 106, i.e. an electric field is the strongest therearound. Accordingly, by spacing the protection cover 111 from the surface of the insulator 106 by the gap 120, an attracting force of static electricity induced at the surface of the insulator 106 is largely weakened at an outer surface of the protection cover 111 so that it is possible to largely reduce an amount of the metallic powders to be attracted and adhered to the outer surface of the protection cover 111 around the tubular section 105 of the metallic base 103. As a result, sparks can be prevented from generating between the terminal pins 107 and the tubular sections 105 of the metallic base 103.

In this prior art structure, however, a pressure within each gap 120 is determined by an ambient atmospheric pressure at the time of mounting the protection cover 111 to the hermetic terminal 100. Since the protection cover 111 is thin, i.e. it is formed of a thin plate of a synthetic resin, such as, PET, and further, a pressure in the sealed case 109 is variable according to operating and non-operating conditions of the compressor, a magnitude of the gap 120 should be set rather small so as to prevent the protection cover 111 from displacing due to the variation of the pressure in the sealed case 109. As a result, it is practically impossible to largely space the protection cover 111 from the surfaces of the insulators 106 where the number of electric force lines is the largest, so that the attraction of the metallic powders to the protection cover 111 due to the induced static electricity can not be prevented effectively or sufficiently. This leads to generation of the sparks between the terminal pins 107 and the tubular sections 105 of the metallic base 103 through the adhered metallic powders on the surface of the protection cover 111 so that the leak or the like is resulted.

Further, since the prior art protection cover 111 is made of the thin plate having a small heat capacity, it is possible that portions of the protection cover 111 heated due to the generated sparks may be lost to cause the insulator 106 to be exposed, leading to accidents, such as, the leak and the breakage of the hermetic terminal.

It is also to be appreciated that, since the prior art protection cover 111 is thin as a whole, it is difficult to handle it, meaning that mounting it onto the hermetic terminal 100 can not be done smoothly.

Further, since the prior art protection cover 111 is designed to entirely cover a bottom of the dish-shaped metallic base 103 including the three continuous terminal strips 101, air is enclosed or caught between the protection cover 111 and the bottom of the metallic base 103 when the protection cover 111 is mounted to the hermetic terminal 100, so that the tightness therebetween becomes poor. For solving this problem, the small hole 114 is formed at the center of the protection cover 111 for an air vent so as to prevent the air from remaining between the protection cover 111 and the bottom of the metallic base 103. However, since the protection cover 111 is so thin, it can not be avoided that cockles or wrinkles are generated to catch the air therein. As a result, it becomes necessary to move the caught air toward the air vent hole 114 by smoothing the wrinkles by, such as, operator's hands after having mounted the protection cover 111 onto the metallic base 103, so as to release the air little by little through the air vent hole 114, which is complicated and troublesome.

Still further, since each of the stepped tubular portions 113 (hereinafter also referred to as "the protection caps") of the protection cover 111 is continuous with a planar base portion of the protection cover 111 via an annular folded portion or the like, a positional freedom of each protection cap is strictly limited, i.e. a degree of the positional freedom of each protection cap is very small. On the other hand, in the hermetic terminal 100, it is likely to happen that the terminal pin 107 is not arranged straight but bent, or the terminal pins 107 are not arranged in parallel with each other, i.e. a degree of parallelization is poor. Accordingly, when mounting the prior art protection cover 111 onto the hermetic terminal having such an irregular terminal pin, the assembling operation becomes quite troublesome due to the very small degree of the positional freedom of the protection caps 113 of the protection cover 111.

In addition, when forcibly mounting the protection cover 111 to such a hermetic terminal 100, an unexpected excessive force is applied to one or more of the small-diameter openings 118 for receiving the terminal pin or pins 107 therethrough so that the small-diameter opening 118 is forced to be permanently enlarged. As a result, a gap or clearance is generated between the terminal pin 107 and the corresponding wall defining the small-diameter opening 118, resulting in invasion of the metallic powders therethrough. It is to be appreciated that, even when the terminal pins 107 are straight and arranged in parallel with each other, there still remains a problem of the invasion of the metallic powders through such a clearance to cause a short circuit due to the fact that no particular measures for ensuring the tightness between the terminal pins 107 and the protection cover 111 are provided.

In order to avoid the expansion or enlargement of the small-diameter opening 118 as described above, it is effective to apply a force in advance to expand a portion, other than the protection caps, of the protection cover 111 which will contact the bottom of the metallic base 103 and then to mount the protection cover 111 onto the hermetic terminal 100. Although this facilitates the assembling operation, there still remains a problem of generation of wrinkles at the expanded portion of the protection cover 111 after the protection cover has been mounted onto the hermetic terminal 100.

SUMMARY OF THE INVENTION

Therefore, it is an object of the present invention to provide an improved hermetic terminal cover that can eliminate the above-noted defects inherent in the conventional hermetic terminal cover.

It is another object of the present invention to provide an improved closed-type compressor incorporating such a hermetic terminal cover, so as to eliminate the above-noted defects inherent in a closed-type compressor incorporating the conventional hermetic terminal cover.

To accomplish the above-mentioned and other objects, according to one aspect of the present invention, a hermetic terminal cover of an insulating material arranged to be attached to a hermetic terminal which includes a metallic base having a metallic tubular section and a terminal pin fixedly passing through the metallic tubular section with an insulator interposed therebetween, comprises a tubular seal section tightly fitted around the metallic tubular section; a terminal pin receiving section having a tapered inner surface and tightly fitted around the terminal pin; and a cover section arranged between the tubular seal section and the terminal pin receiving section in continuous relation thereto, the cover section having a tapered inner surface and facing the insulator, the cover section having an increased thickness relative to the tubular seal section and the terminal pin receiving section.

According to another aspect of the present invention, a hermetic terminal cover of an insulating material arranged to be attached to a hermetic terminal which includes a metallic base having a plurality of metallic tubular sections and terminal pins each fixedly passing through the corresponding metallic tubular section with an insulator interposed therebetween, comprises a plurality of terminal caps each of which is tightly fitted around at least the metallic tubular section and the terminal pin, the terminal caps being mutually coupled by flexible rib means.

According to a further aspect of the present invention, a closed-type compressor having compressing means and motor means in a sealed case and a hermetic terminal mounted to the sealed case for feeding power to the motor means which in turn drives the compressing means, comprises the hermetic terminal having a terminal strip on a metallic base, the terminal strip having a metallic tubular section and a terminal pin fixedly passing through the metallic tubular section with an insulator interposed therebetween; and a hermetic terminal cover of an insulating material arranged to be attached to the terminal strip, the hermetic terminal cover including a tubular seal section tightly fitted around the metallic tubular section; a terminal pin receiving section having a tapered inner surface and tightly fitted around the terminal pin; and a cover section arranged between the tubular seal section and the terminal pin receiving section in continuous relation thereto, the cover section having a tapered inner surface and facing the insulator, the cover section having an increased thickness relative to the tubular seal section and the terminal pin receiving section.

According to a still further aspect of the present invention, a closed-type compressor having compressing means and motor means in a sealed case and a hermetic terminal mounted to the sealed case for feeding power to the motor means which in turn drives the compressing means, comprises the hermetic terminal having terminal strips on a metallic base, the terminal strips each having a metallic tubular section and a terminal pin fixedly passing through the metallic tubular section with an insulator interposed therebetween; and a hermetic terminal cover of an insulating material arranged to be attached to the terminal strips, the hermetic terminal cover including a plurality of terminal caps each of which is tightly fitted around at least the metallic tubular section and the terminal pin, the terminal caps being mutually coupled by flexible rib means.

BRIEF DESCRIPTION OF THE DRAWINGS

The present invention will be understood more fully from the detailed description given hereinbelow and from the accompanying drawings of the preferred embodiments of the invention, which are given by way of example only, and are not intended to be limitative of the present invention.

In the drawings.

DESCRIPTION OF THE PREFERRED EMBODIMENT

Figure 12:
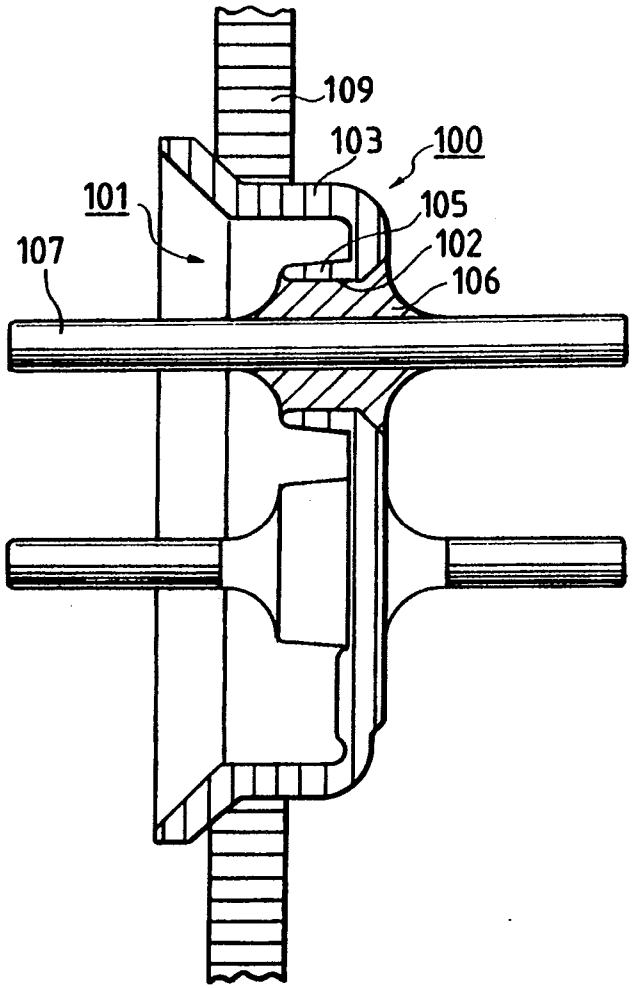
FIG. 12 PRIOR ART
FIG. 12 is a sectional view of the hermetic terminal.
Figure 13:
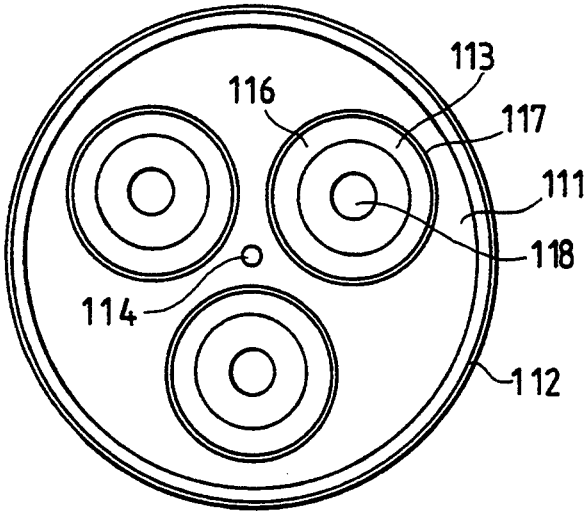
FIG. 13 PRIOR ART
FIG. 13 is a front elevation of a conventional hermetic terminal cover.
Figure 14:
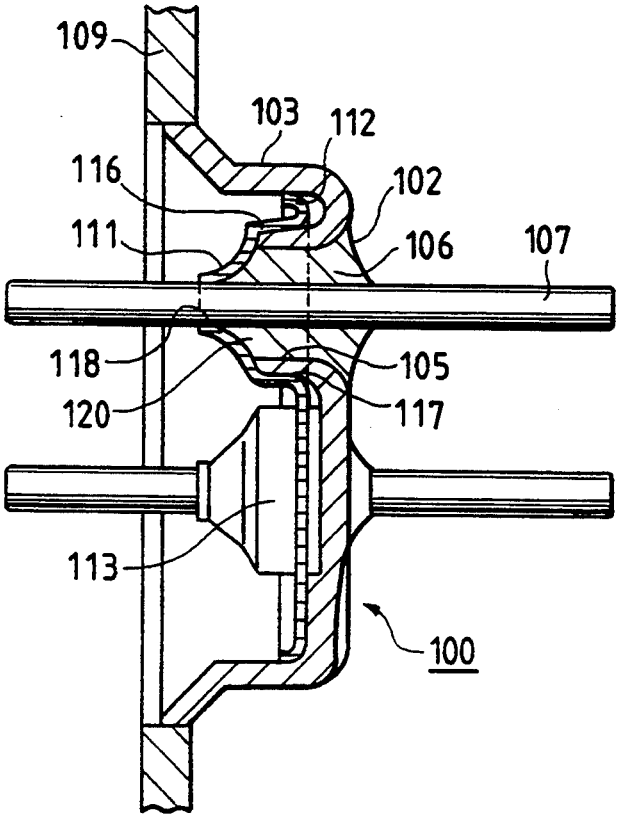
FIG. 14 PRIOR ART
FIG. 14 is a sectional view showing an assembled state, wherein the conventional hermetic terminal cover of FIG. 13 is mounted onto the hermetic terminal.

Referring now to the drawings, preferred embodiments of the present invention will be described with reference to FIGS. 1 through 11. Since the hermetic terminal itself requires no modification from the foregoing conventional one, the same reference numerals as in FIGS. 12 to 14 are used in the following preferred embodiments of FIGS. 1 through 9 to designate or represent members or elements the same as or similar to those in FIGS. 12 to 14, so as to omit explanation thereof for avoiding redundant disclosure.

Figure 1:
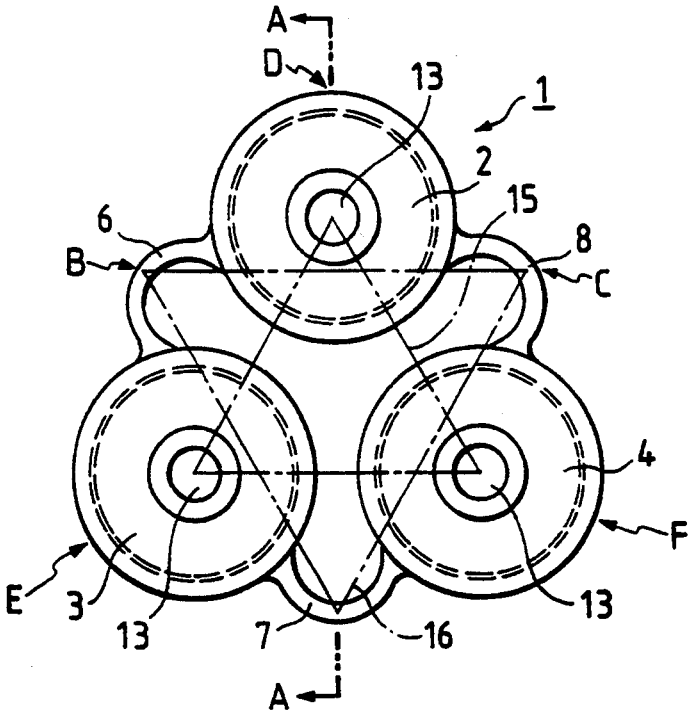
FIG. 1 is a front elevation of a hermetic terminal cover according to a preferred embodiment of the present invention.
Figure 2:
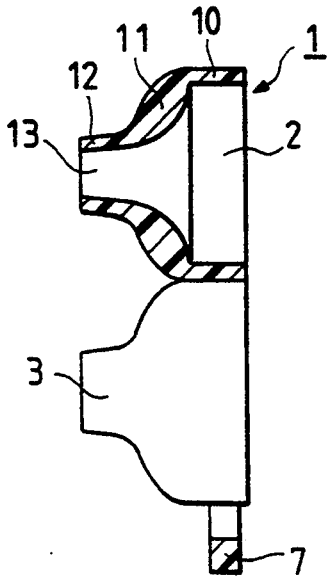
FIG. 2 is a sectional view of the hermetic terminal cover in FIG. 1, taken along a line A—A.
Figure 3:
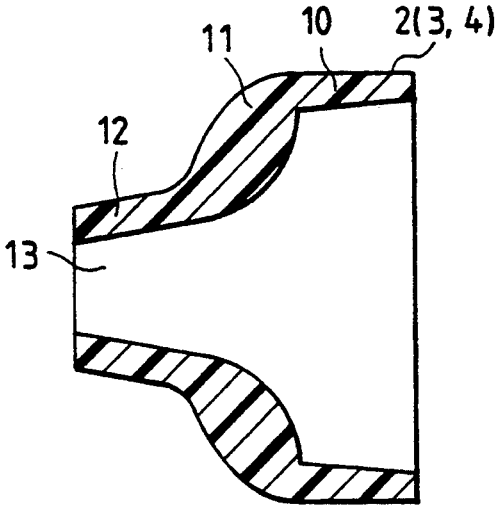
FIG. 3 is an enlarged sectional view of one of terminal caps of the hermetic terminal cover in FIG. 1.
Figure 5:
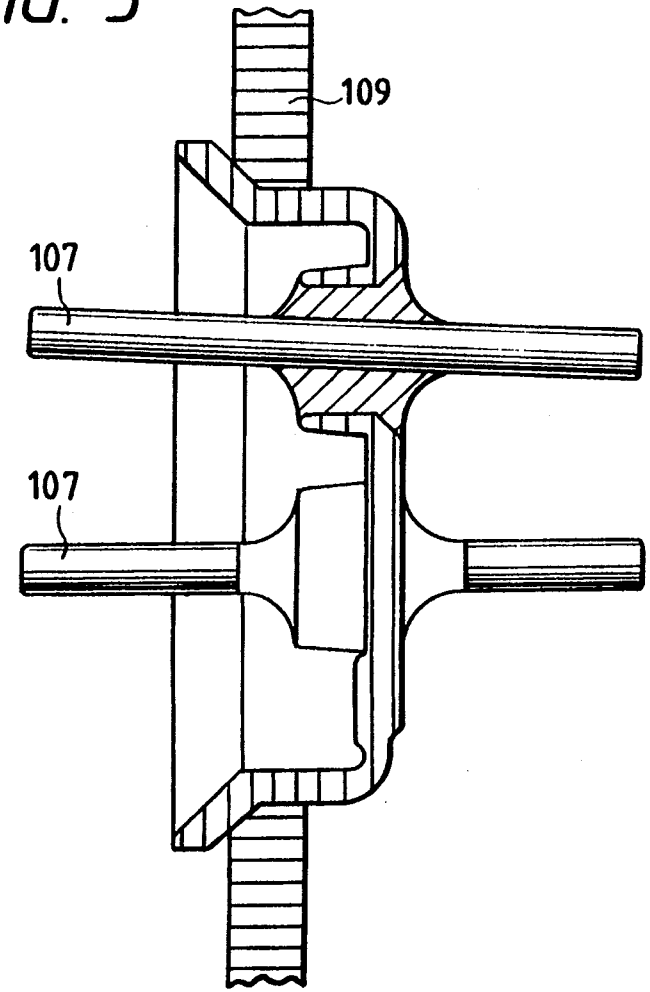
FIG. 5 is a sectional view of the hermetic terminal, wherein one of terminal pins of the hermetic terminal is inclined to another terminal pin, i.e. a degree of parallelization is poor between the shown terminal pins.
Figure 4:
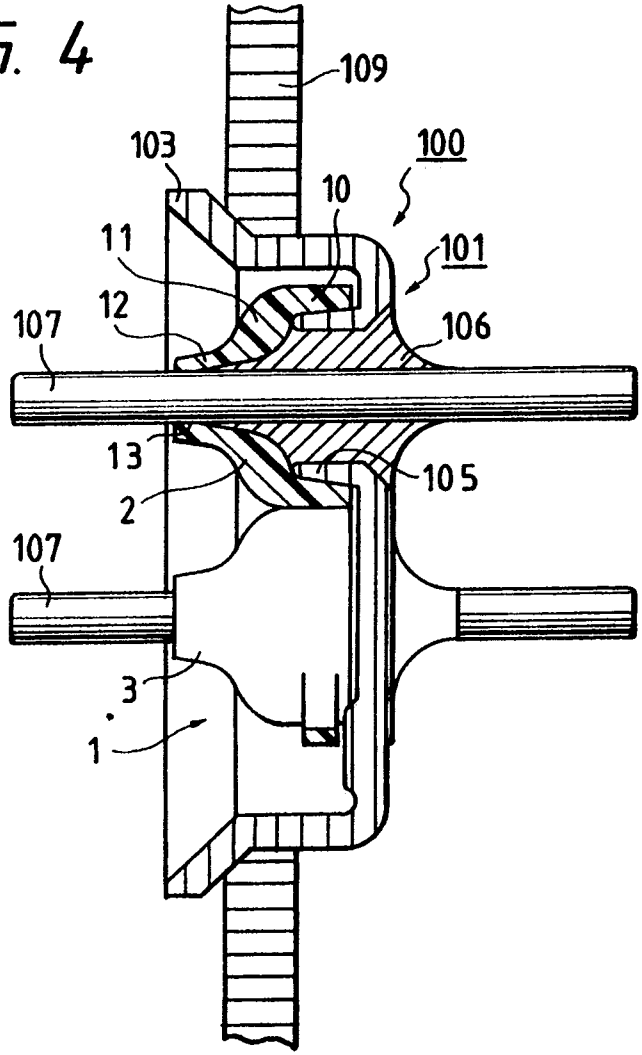
FIG. 4 is a sectional view showing an assembled state, wherein the hermetic terminal cover of FIG. 1 is mounted onto a hermetic terminal.
Figure 8:
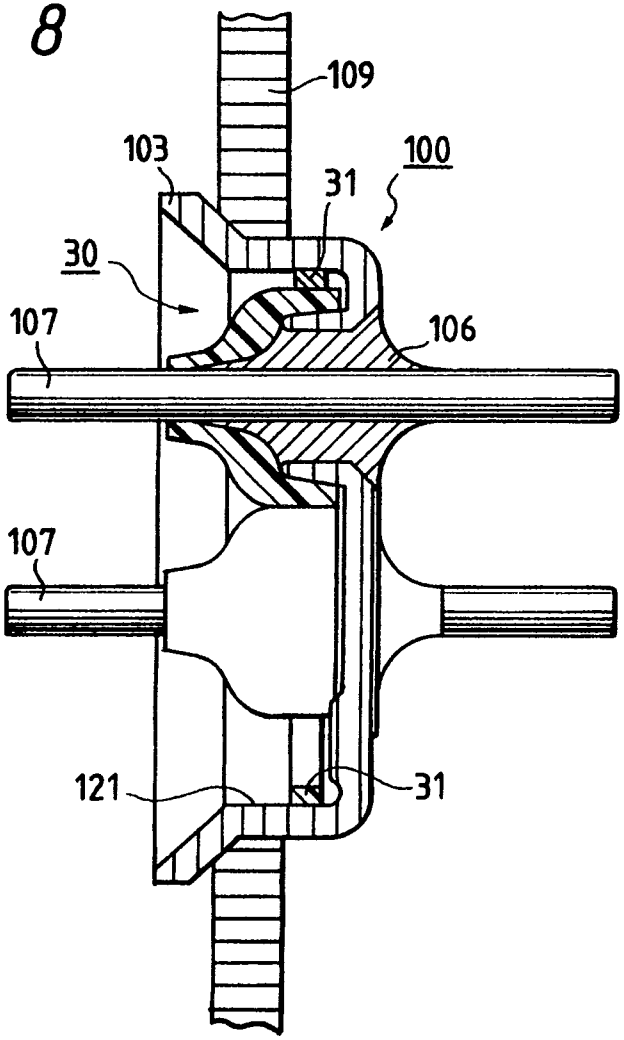
FIG. 8 is a sectional view showing an assembled state, wherein the hermetic terminal cover of FIG. 7 is mounted onto the hermetic terminal.
Figure 6:
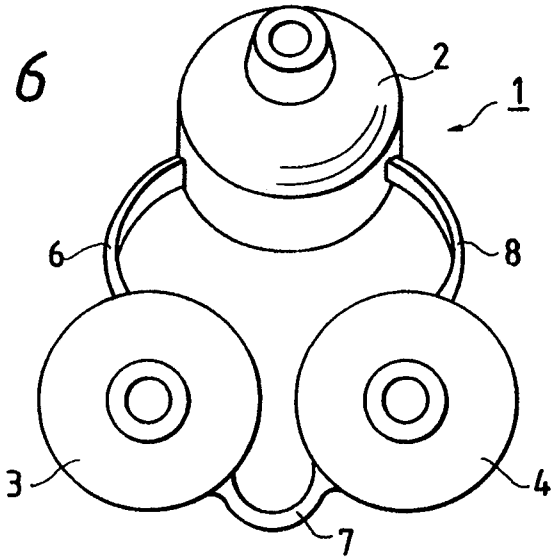
FIG. 6 is a front elevation of the hermetic terminal cover of FIG. 1 for explaining its behavior when mounted to the hermetic terminal of FIG. 5.
Figure 7:
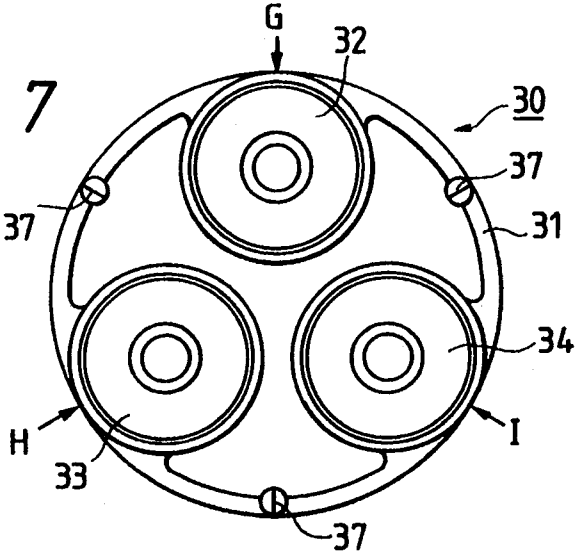
FIG. 7 is a front elevation of a hermetic terminal cover according to another preferred embodiment of the present invention.
Figure 9:
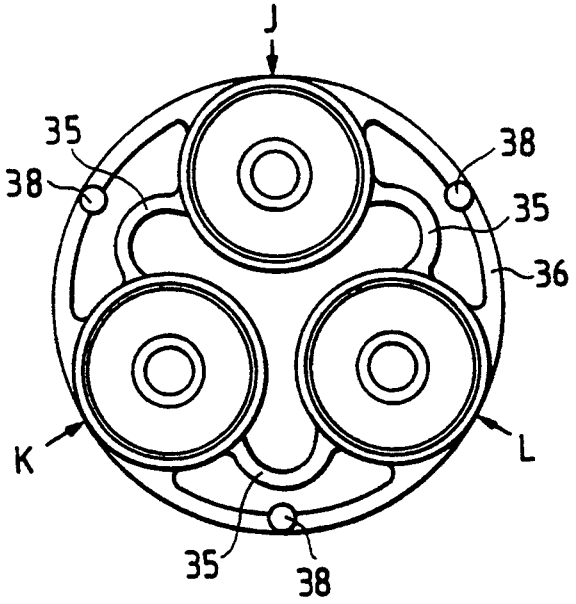
FIG. 9 is a front elevation of a hermetic terminal cover according to still another preferred embodiment of the present invention.

FIG. 1 is a front elevation of a hermetic terminal cover according to a preferred embodiment of the present invention. FIG. 2 is a sectional view of the hermetic terminal cover in FIG. 1, taken along a line A—A. FIG. 3 is an enlarged sectional view of one of terminal caps of the hermetic terminal cover in FIG. 1. FIG. 4 is a sectional view showing an assembled state, wherein the hermetic terminal cover of FIG. 1 is mounted onto the hermetic terminal. FIG. 5 is a sectional view of the hermetic terminal, wherein one of terminal pins of the hermetic terminal is inclined to another terminal pin, i.e. a degree of parallelization is poor between the shown terminal pins. FIG. 6 is a front elevation of the hermetic terminal cover of FIG. 1 for explaining its behavior when mounted to the hermetic terminal of FIG. 5. FIG. 7 is a front elevation of a hermetic terminal cover according to another preferred embodiment of the present invention. FIG. 8 is a sectional view showing an assembled state, wherein the hermetic terminal cover of FIG. 7 is mounted onto the hermetic terminal. FIG. 9 is a front elevation of a hermetic terminal cover according to still another preferred embodiment of the present invention.

In FIG. 1, a reference numeral 1 denotes the hermetic terminal cover of the preferred embodiment. The hermetic terminal cover 1 is made of polybutylene terephthalate by the injection molding, having a high oil resistance, a high refrigerant resistance, a high insulating characteristic and a high voltage resistance. The hermetic terminal cover 1 includes three terminal caps 2, 3 and 4 which are mutually coupled by respective ribs 6, 7 and 8. The terminal caps 2, 3 and 4 are mutually of the same shape similar to an upper portion of a bottle, as shown in FIG. 2. Each of the terminal caps 2, 3 and 4 covers the corresponding terminal strip 101 of the hermetic terminal 100, and includes a tubular seal section 10 of a relatively large diameter, a cover section 11 extending from the tubular seal section 10 and sharply tapering in a direction away from the tubular seal section 10, and a terminal pin receiving section 12 extending from the cover section 11 and moderately or loosely tapering in a direction away from the cover section 11.

In order to fit the tubular seal section 10 tightly around the tubular section 105 of the metallic base 103 as shown in FIG. 4, an inner diameter of the tubular seal section 10 is set equal to or slightly smaller than an outer diameter of the tubular section 105. The cover section 11 covers the exposed surface of the insulator 106 of the hermetic terminal 100 as shown in FIG. 4. The cover section 11 has an inner periphery whose section along a length of the corresponding terminal pin 107 forms a curved line of a circular arc and tapers toward the terminal pin receiving section 12. As clearly shown in FIG. 3, thicknesses of the cover section 11 are set larger than those of the remaining portions of the terminal cap 2 (3, 4), i.e. about between 1 mm and 3 mm. An inner periphery of the terminal pin receiving section 12 is of just a tapering shape toward its tip opening 13. An inner diameter of this tip opening 13 is set slightly smaller than a diameter of the terminal pin 107.

As shown by a dashed line 15 in FIG. 1, the centers of the terminal caps 2, 3 and 4 are located at respective apexes of an equilateral triangle, and the adjacent terminal caps 2, 3 and 4 are respectively adjoined by the three ribs 6, 7 and 8 to substantially form an annular unit. Accordingly, each terminal cap has two of the ribs adjoined thereto. Each rib 6 (7, 8) extends from an outer periphery of the tubular seal section 10 such that the adjoining portions of the two ribs with the tubular seal section 10 are substantially in line with the tip opening 13 of the terminal pin receiving section 12 and located at symmetrical positions with respect to a line extending through the apex of the equilateral triangle 15 and the middle point on the corresponding base thereof, as shown in FIG. 1.

As shown in FIG. 2, each rib 6 (7, 8) is adjoined to the tubular seal section 10 spacing a small distance from a free end of the tubular seal section 10. The reason for this is that, since the metallic base 103 of the hermetic terminal 100 generally has rugged or jagged surfaces for increasing its rigidity, it is preferable for each rib to avoid interference with the rugged surfaces of the metallic base 103 so as to ensure tight connection between the hermetic terminal cover 1 and the metallic base 103.

As shown in FIG. 1, each rib 6 (7, 8) has a shape of a circular arc with its radius being smaller than that of the terminal cap 2 (3, 4). Accordingly, each rib is laterally bulged with a sufficient margin of length. The three ribs 6, 7 and 8 have the same shape with each other so that a dashed line 16 connecting the middle points of the circular arc of the respective ribs 6, 7 and 8 also forms an equilateral triangle which is inverted by an angle of 180 degrees relative to the equilateral triangle drawn by the dashed line 15. Further, it is preferable that a tangential line of each rib 6 (7, 8) is substantially in line with a normal line of the terminal cap 2 (3, 4) at the adjoining portion of the rib 6 (7, 8) with the corresponding tubular seal section 10 of the terminal cap, as shown in FIG. 1. This is effective for allowing the maximum freedom in the turning action of each terminal cap.

As shown in FIG. 4, the hermetic terminal cover 1 as structured above is mounted onto an inner side of the hermetic terminal 100, i.e. a side of the hermetic terminal 100 facing the interior of the closed-type compressor. Specifically, the hermetic terminal cover 1 is mounted onto the terminal strips 101 of the hermetic terminal 100 with its tubular seal sections 10 being tightly fitted around the corresponding metallic tubular sections 105, with its cover sections 11 being adjoining the exposed surfaces of the corresponding insulators 106, and with its terminal pin receiving sections 12 tightly receiving the corresponding terminal pins 107 therethrough.

When mounting the hermetic terminal cover 1 onto the hermetic terminal 100, the terminal caps 2, 3 and 4 are respectively first brought into contact with the corresponding terminal pins 107 at their inner peripheries, and then slowly forced further toward the bottom of the metallic base 103 by operator's hands. Normally, a tip of each terminal pin 107 is first brought into contact with the inner periphery of the cover section 11. However, since the inner periphery of the cover section 11 is tapered toward the tip opening 13, the tip of the terminal pin 107 is guided toward the terminal pin receiving section 12 along the tapered inner periphery of the cover section 11 as the hermetic terminal cover 1 slowly advances toward the bottom of the metallic base 103. Although the inner diameter of the tip opening 13 of the terminal pin receiving section 12 is set smaller than the diameter of the terminal pin 107, since the inner periphery of the terminal pin receiving section 12 is just tapered, the terminal pin receiving section 12 is forced enlarged as the terminal pin 107 slowly advances relative to the terminal pin receiving section 12. As a result, the tip of the terminal pin 107 passes through the tip opening 13 with its outer periphery being in tight contact with the inner periphery of the terminal pin receiving section 12.

After the tip of each terminal pin 107 passes through the tip opening 13, the three terminal caps 2, 3 and 4 are simultaneously and slowly forced further toward the bottom of the metallic base 103, keeping balance among the three terminal caps 2, 3 and 4. Subsequently, when the annular free end of each tubular seal section 10 remote from the tip opening 13 reaches the metallic tubular section 105 of the hermetic terminal 100, some more force is applied to each terminal cap so as to forcibly fit the tubular seal section 10 around the metallic tubular section 105 for firmly coupling them.

Assuming that one of the terminal pins 107 is arranged not in parallel with the other terminal pins 107 as shown in FIG. 5, the following operations may be performed for mounting the hermetic terminal cover 1 onto the hermetic terminal 100:

First, middle portions identified by B and C in FIG. 1 of the ribs 6 and 8 are simultaneously pressed inward by operator's hands. This causes the ribs 6 and 8 to change their shapes to be linear, respectively, due to their flexible nature. As a result, the terminal cap 2 alone makes a parallel displacement in an upper direction in FIG. 1. At this time, since only the ribs 6 and 8 receive the force directly from the operator, i.e. no force is applied to the terminal cap 2 directly from the operator, the terminal cap 2 itself makes no deformation. Under this condition, each terminal cap 2 (3, 4) is brought into contact with the tip of the terminal pin 107, and then advanced toward the bottom of the metallic base 103 as in the foregoing manner for the terminal pins being arranged in parallel with each other. This results in that only the ribs 6 and 8 are twisted to make the terminal cap 2 alone turn outward, as shown in FIG. 6, so that all the terminal pins 107 are smoothly guided to the terminal pin receiving sections 12 of the terminal caps 2, 3 and 4.

Thereafter, the hermetic terminal cover 1 is forced onto the hermetic terminal 100 with the terminal cap 2 gradually returning to its normal posture from the posture shown in FIG. 6. Since a deviation of the non-parallel terminal pin 107 from the normal position is very small at a location where the non-parallel terminal pin 107 comes out from the insulator 106, the terminal cap 2 substantially returns to the normal position after the hermetic terminal cover 1 has been mounted onto the hermetic terminal 100, i.e. after the tubular seal section 10 of the terminal cap 2 has been firmly fitted around the tubular section 105 of the metallic base 103. Accordingly, even in the case of the terminal pin 107 being non-parallel with the-other terminal pins 107, the terminal cap 2 can be mounted onto the corresponding terminal strip 101 in a manner which ensures the tight connections between the tubular seal section 10 and the metallic tubular section 103 and between the terminal pin receiving section 12 and the terminal pin 107 as in the case of the terminal pin 107 being parallel with the other terminal pins 107. Further, since the ribs 6 and 8 have been deformed only temporally by the applied force, which does not cause permanent deformation thereof, these ribs return to their normal posture and no wrinkles remain after the hermetic terminal cover 1 has been mounted onto the hermetic terminal 100.

In the foregoing preferred embodiment, each terminal cap 2 (3, 4) receives the corresponding two of the three ribs 6, 7 and 8 substantially on the diametrical line thereof, and each rib is of a shape of a circular arc having a radius of curvature smaller than that of the terminal cap. In fact, this structure of the ribs is preferable in view of allowing the large displacement of the terminal caps 2, 3 and 4. However, the structure of the ribs is not to be limited to the foregoing preferred embodiment. For example, each rib may have a linear shape, a hook shape or others.

FIG. 7 shows a modification of the hermetic terminal cover 1 as shown in FIG. 1. A hermetic terminal cover 30 of FIG. 7 only differs from the hermetic terminal cover 1 of FIG. 1 in a rib structure including a rib shape. In FIG. 7, a rib 31 of the hermetic terminal cover 30 forms a circumscribed circle of terminal caps 32, 33 and 34. Specifically, the terminal caps 32, 33 and 34 are arranged at respective apexes of an equilateral triangle as in FIG. 1, and each rib component of the rib 31 is extended from radially outermost portions of the corresponding terminal caps with respect the center of the hermetic terminal cover 30. The rib components of the rib 31 have the same arc shape with each other, and an equilateral triangle which is angularly inverted by 180 degrees with respect to the equilateral triangle of the terminal caps is formed by apexes located at the middle points of the respective rib components. Accordingly, a radius of the annular rib 31 is equal to a radius of a circle which connects radially outermost points of the respective terminal caps 32, 33 and 34 with respect to the center of the hermetic terminal cover 30. Further, the radius of this circle, i.e. the circumscribed circle is substantially equal to a radius of the circular bottom of the metallic base 103.

Although the hermetic terminal cover 30 of FIG. 7 has, in comparison with the hermetic terminal cover 1 of FIG. 1, less degree of positional or displacement freedom of the terminal caps, each terminal cap shows stabler behavior than that in FIG. 1 so that the hermetic terminal cover 30 facilitates the mounting operation thereof onto the hermetic terminal 100. In addition, after the hermetic terminal cover 30 has been mounted onto the hermetic terminal 100, an inner periphery 121 of the dish-shaped metallic base 103 remains in contact with an outer periphery of the rib 31 to ensure more reliable coupling between the hermetic terminal cover 30 and the hermetic terminal 100, as shown in FIG. 8. As a result, for example, even if the hermetic terminal 100 is subjected to strong vibration for a long time, the hermetic terminal cover 30 is effectively prevented from coming off the hermetic terminal 100.

FIG. 9 shows a further modification of the hermetic terminal cover 1 as shown in FIG. 1. As seen in FIG. 9, this modification is a combination of the foregoing preferred embodiments of FIGS. 1 and 7. Specifically, the hermetic terminal cover of FIG. 9 includes ribs 35 which correspond to the ribs 6, 7 and 8 in FIG. 1 and a rib 36 which corresponds to the rib 31 in FIG. 7.

Now, a preferred method of producing the hermetic terminal covers according to the foregoing preferred embodiments will be described hereinbelow.

In general, the hermetic terminal cover is small in size and mass-produced. Accordingly, the injection molding is recommendable for producing the hermetic terminal cover. When molding the hermetic terminal cover of any one of the foregoing preferred embodiments by the injection molding, a special attention must be brought to a position or location where a weld line or mark is generated. Specifically, in order to prevent invasion of the refrigerant and others into the surface of each insulator 106, particularly the inner peripheries of the tubular seal section 10 and the terminal pin receiving section 12 must be formed smooth enough for ensuring the tight coupling with the metallic tubular section 105 and the terminal pin 107, respectively. Accordingly, when molding the hermetic terminal cover by the injection molding, the weld line should be prevented from generating at the tubular seal section 10 or the terminal pin receiving section 12 since the weld line deteriorates the smoothness of the inner peripheries thereof.

Accordingly, in the preferred method according to the present invention, molding material injection gates or mold gates are arranged at molding cavities which are for molding the respective terminal caps, and each mold gate is located equally distant from the corresponding ribs or the corresponding rib components. Specifically, in FIG. 1, the mold gates are arranged at locations identified by arrows D, E and F, respectively. Similarly, the mold gates are arranged at locations identified by arrows G, H and I in FIG. 7, and by arrows J, K and L in FIG. 9. It is desirable that each mold gate is located equally distant from a nozzle of the injection molding machine.

Analysis will be made to the flow of the injected molding material, i.e. the thermoplastic resin within the mold as structured above.

The thermoplastic resin injected through each mold gate first fills up the molding cavity for the terminal cap. After the molding cavity for the terminal cap is filled up, an excess portion of the thermoplastic resin flows into molding cavities for the ribs. Accordingly, the separately injected molding materials of the thermoplastic resin flow into the corresponding molding cavities for the ribs after completely filling up the cavities for the terminal caps. It is to be appreciated that, since the ribs and/or the rib components have the same shape with each other and the equilateral triangle is formed by the apexes located at the middle points of the respective ribs or the respective rib components and is angularly inverted by 180 degrees with respect to the equilateral triangle as identified by the dashed line 15 in FIG. 1, the separately injected molding materials of the thermoplastic resin which flow into the molding cavities for the respective ribs and/or the respective rib components collide with each other at the middle points thereof to form the weld lines there. This means that the terminal caps are uniformly molded with no weld line included. Material wells 37 or 38 in FIG. 7 or FIG. 9 may be provided at the molding cavities for the ribs or the rib components for ensuring formation of the weld lines at these material wells. The material wells further work to reinforce the ribs or the rib components at the weld lines which otherwise deteriorate the strength thereof.

Figure 10:
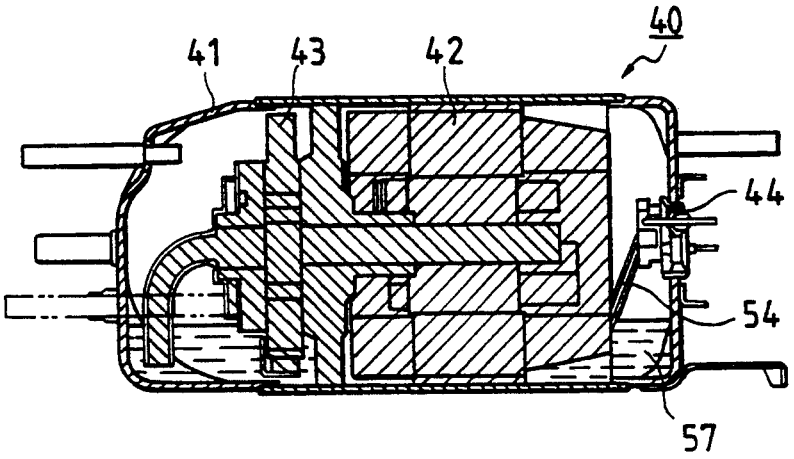
FIG. 10 is a front sectional view of a closed-type compressor according to a preferred embodiment of the present invention.
Figure 11:
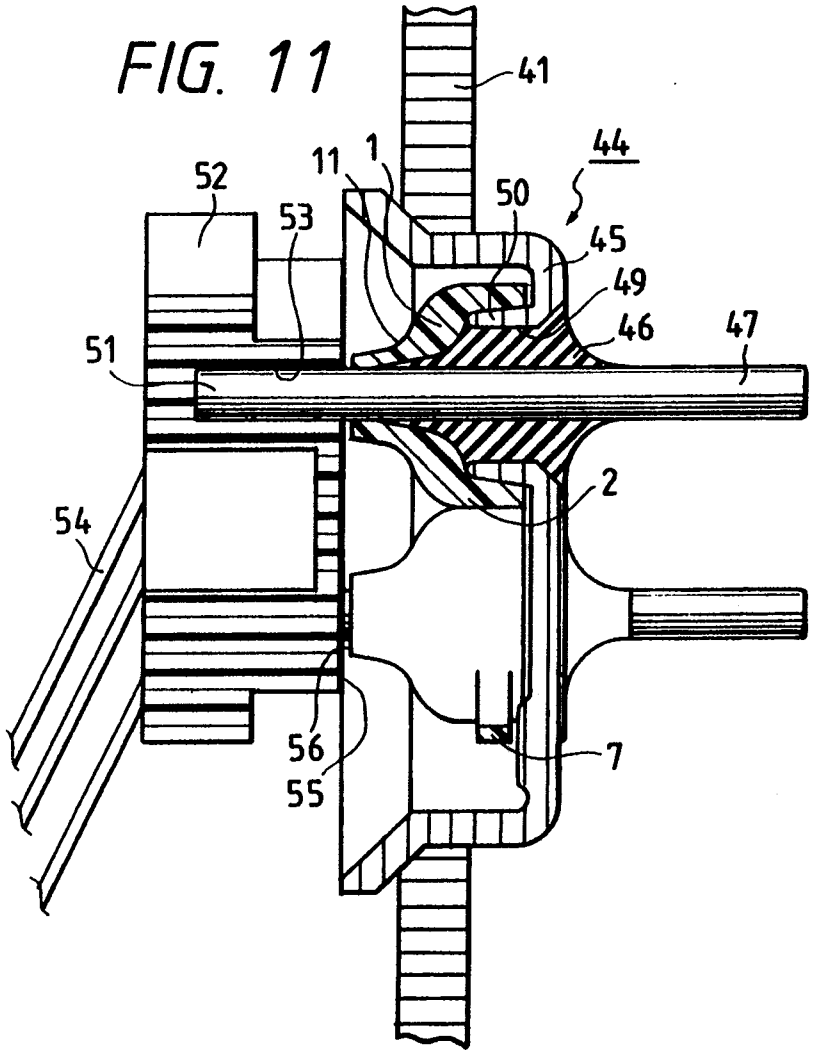
FIG. 11 is an enlarged sectional view showing a relevant portion of the closed-type compressor of FIG. 10 around the hermetic terminal.

Now, explanation will be made hereinbelow about a closed-type compressor incorporating one of the hermetic terminal covers of the foregoing preferred embodiments. FIG. 10 is a front sectional view of the closed-type compressor according to a preferred embodiment of the present invention, and FIG. 11 is an enlarged sectional view showing a relevant portion of the closed-type compressor of FIG. 10 around the hermetic terminal.

In FIG. 10, a reference numeral 40 denotes the closed-type compressor which is generally used in a refrigerator, a room air conditioner or the like. The closed-type compressor 40 includes a sealed case 41 in which an electric motor 42 and a compressor unit 43 are arranged in series as the conventional closed-type compressor. The electric motor 42 includes a rotor having a rotation shaft with a coil wound therearound, and stator coils provided around the rotor. The compressor unit 43 is operated by a rotational force or torque transmitted from the electric motor 42 for compressing the refrigerant. Since the electric motor 42 and the compressor unit 43 do not differ at all from the conventional ones, no further explanation thereof will be given hereinbelow.

A hermetic terminal 44 is fixedly mounted to the sealed case 41 at a side remote from the compressor unit 43. As shown in FIG. 11, the hermetic terminal 44 includes a dish-shaped metallic base 45, three glass insulators 46 and three terminal pins 47. The metallic base 45 is welded to the sealed case 41 and includes three holes 49 respectively defined by tubular sections 50 of the metallic base 45. Each terminal pin 47 is made of an alloy of iron, nickel and cobalt and passes through the center of the tubular section 50 with the glass insulator hermetically interposed between the terminal pin 47 and the tubular section 50. Accordingly, each terminal pin 47 is fixed in the tubular section 50 as being electrically insulated therefrom, and each hole 49 is hermetically closed by the insulator 46.

The hermetic terminal cover 1 is mounted onto an inner side of the hermetic terminal 44, i.e. a side of the hermetic terminal facing the interior of the closed-type compressor 40. The hermetic terminal cover 1 employed herein is identical to that as shown in FIG. 1. Accordingly, the hermetic terminal cover 1 is mounted onto the hermetic terminal 44 with its tubular seal sections 10 and terminal pin receiving sections 12 being tightly fitted around the corresponding tubular sections 50 and the terminal pins 47 of the hermetic terminal 44. Although the hermetic terminal cover 1 is mounted to the hermetic terminal 44 after the hermetic terminal 44 has been welded to the sealed case 41, since each of the terminal caps 2, 3 and 4 is allowed the large positional or displacement freedom as described before and is formed with the tapered inner peripheries as also described before, the mounting operation of the hermetic terminal cover 1 is facilitated.

The terminal pins 47 respectively pass through between inside and outside of the sealed case 41 for feeding power to the internal electric motor 42. Specifically, the terminal pins 47 are connected to an external power source (not shown) outside the sealed case 41 and to a cluster 52 inside the sealed case 41. As shown in FIG. 11, an inward protruding portion 51 of each terminal pin 47 is received in an insertion hole 53 of the cluster 52. The cluster 52 includes electric wires 54 which are connected to the electric motor 42 for connecting the terminal pins 47 to the electric motor 42.

Dimensional relationship among a length of the inward protruding portion 51 of each terminal pin 47, a height of each terminal cap 2 (3, 4) along the length of the inward protruding portion 51 and a depth of each insertion hole 53 of the cluster 52 is very important in this embodiment, which is as follows:

Specifically, the dimensional relationship is set such that a gap of about 0.1 mm to 1 mm is provided between an end surface 55 of the cluster 52 and an end surface 56 of the terminal pin receiving section 12 of each terminal cap 2 (3, 4) when the inward protruding portion 51 of each terminal pin 47 reaches a bottom of the insertion hole 53. As a result, when the cluster 52 is fitted onto the terminal pins 47, the cluster 52 is prevented from abutting against the end surfaces 56 of the hermetic terminal cover 1 so as to ensure the reliable attachment of the cluster 52 to the terminal pins 47.

When the closed-type compressor 40 is operated, the refrigerant is compressed in the compressor unit 43 driven by the electric motor 42. At this time, the oil 57 pooled in the sealed case 41 is agitated and compelled up to the hermetic terminal 44. As a result, the hermetic terminal 44 is exposed to and bathed with the oil 57 and the metallic powders included in the oil 57. However, since the hermetic terminal 44 is protected by the hermetic terminal cover 1, i.e. each terminal strip is covered by the terminal cap 2 (3, 4) with the tubular seal section 10 tightly fitted around the metallic tubular section 50 and with the terminal pin receiving section 12 tightly fitted around the terminal pin 47, each terminal strip is protected from the metallic powders which otherwise directly hit each of the terminal strips.

Further, since the cover section 11 of each terminal cap 2 (3, 4) is formed thicker than the remaining portions of the terminal cap, the metallic powders are prevented from approaching the surface of the insulator 46 closer than a distance defined by the thickness of the cover section 11. Accordingly, the metallic powders are largely spaced from the surface of the insulator 46 where the electric force lines are the largest in number. This means that the hermetic terminal cover 1 not only prevents the metallic powders from adhering to the surfaces of the insulators 46, but also weakens the attraction force of the static electricity which is generated at the end portions of the metallic tubular sections 50 and exerted on the surface of the hermetic terminal cover 1. As a result, it is possible to largely reduce an amount of the metallic powders attracted and adhered to the hermetic terminal cover 1 in the vicinity of the metallic tubular sections 50 so that the sparks which are otherwise generated between the terminal pins 47 and the metallic base 45 are securely prevented.

In addition, even when an extremely large amount of the metallic powders is generated to short-circuit the terminal pin or pins 47 and the metallic base 45 via the surface of the cover section or sections 11, or to cause the sparks therebetween, since a heat capacity of each cover section 11 is large enough, due to its increased thickness, to prevent heated portions thereof from melting to be lost, the worst situation of the breakage of the terminal strip or strips can be surely avoided.

As appreciated, the hermetic terminal cover 1 employed in FIG. 11 may be readily replaced by the foregoing hermetic terminal cover as shown in FIG. 7 or FIG. 9.

It is to be understood that this invention is not to be limited to the preferred embodiments and modifications described above, and that various changes and modifications may be made without departing from the spirit and scope of the invention as defined in the appended claims.

What is claimed is:

1. A hermetic terminal cover of an insulating material arranged to be attached to a hermetic terminal which includes a metallic base having a plurality of metallic tubular sections and terminal pins each fixedly passing through the corresponding metallic tubular section with an insulator interposed therebetween, said hermetic terminal cover comprising:

a plurality of terminal caps each of which is tightly fitted around at least said metallic section and said terminal pin, said terminal caps being mutually coupled by flexible rib means, wherein said rib means includes a plurality of flexible ribs each of which having a curved shape and connecting adjacent two of the terminal caps.

2. The hermetic terminal cover as set forth in claim 1, wherein each terminal cap receives a pair of said ribs around diametrically opposite locations thereof.

3. The hermetic terminal cover as set forth in claim 2, wherein each of said ribs is of an arc shape having a radius of curvature smaller than that of the terminal cap.

4. The hermetic terminal cover as set forth in claim 3, further including additional ribs each of which connects the adjacent two of the terminal caps, said additional ribs forming a circumscribed circle with respect to said terminal caps.

5. The hermetic terminal cover as set forth in claim 1, wherein said ribs form a circumscribed circle with respect to said terminal caps.

6. A closed-type compressor having compressing means and motor means in a sealed case and a hermetic terminal mounted to the sealed case for feeding power to the motor means which in turn drives said compressing means, said closed-type compressor comprising:

said hermetic terminal having terminal strips on a metallic base, said terminal strips each having a metallic tubular section and a terminal pin fixedly passing through said metallic tubular section with an insulator interposed therebetween; and a hermetic terminal cover of an insulating material arranged to be attached to said terminal strips, said hermetic terminal cover including:

a plurality of terminal caps each of which is tightly fitted around at least said metallic tubular section and said terminal pin; and said terminal caps being mutually coupled by flexible rib means wherein said rib means includes a plurality of flexible ribs, each of which having a curved shape and connecting adjacent two of the terminal caps.

7. The closed-type compressor as set forth in claim 6, wherein said hermetic terminal is connected to a cluster in said sealed case for feeding the power to said motor means via said cluster such that said cluster is mounted onto said terminal pins with a predetermined gap ensured between the cluster and said hermetic terminal cover.

8. The closed-type compressor as set forth in claim 7, wherein said cluster is provided with insertion holes which respectively receive therein said terminal pins, and wherein said predetermined gap is provided between the cluster and the hermetic terminal cover when the terminal pins reach bottoms of said insertion holes, respectively.

9. The closed-type compressor as set forth in claim 6, wherein each terminal cap receives a pair of said ribs around diametrically opposite locations thereof.

10. The closed-type compressor as set forth in claim 9, wherein each of said ribs is of an arc shape having a radius of curvature smaller than that of the terminal cap.

11. The closed-type compressor as set forth in claim 10, further including additional ribs each of which connects the adjacent two of the terminal caps, said additional ribs forming a circumscribed circle with respect to said terminal caps.

12. The closed-type compressor as set forth in claim 6, wherein said ribs form a circumscribed circle with respect to said terminal caps.

* * * * *